US006076697A

United States Patent [19]

Allabaugh, Jr.

[11] Patent Number: 6,076,697

[45] Date of Patent: Jun. 20, 2000

[54] CRATE FOR CARTONS

[76] Inventor: Robert Carleton Allabaugh, Jr., P.O. Box 1919, 404 Osceloa St., Minneola, Fla. 34755

[21] Appl. No.: 08/873,145

[22] Filed: Jun. 9, 1997

[51] Int. Cl.[7] ..... B65D 1/24

[52] U.S. Cl. ..... 220/509; 220/516; 220/DIG. 15; 206/427

[58] Field of Search ..... 206/203, 427; 220/509, 516, 518, DIG. 15

[56] References Cited

U.S. PATENT DOCUMENTS

| | | | |
|---|---|---|---|
| D. 212,074 | 8/1968 | Woodruff et al. | D9/177 |
| 2,758,742 | 8/1956 | Farrell | 220/21 |
| 3,301,428 | 1/1967 | Erickson | 220/4 |
| 3,376,998 | 4/1968 | Cornelius | 220/102 |
| 3,443,717 | 5/1969 | Wettlen et al. | 220/66 |
| 3,802,595 | 4/1974 | Frahm et al. | 220/66 |
| 3,870,151 | 3/1975 | Tray | 206/507 |
| 3,870,188 | 3/1975 | Buffett | 220/72 |
| 4,213,529 | 7/1980 | Whitaker | 206/427 |
| 4,520,941 | 6/1985 | Hagan et al. | 220/72 |
| 4,548,320 | 10/1985 | Box | 206/427 |
| 4,619,371 | 10/1986 | Rehrig | 206/427 |
| 4,700,837 | 10/1987 | Hammett | 206/427 |
| 5,060,819 | 10/1991 | Apps | 220/519 |
| 5,188,233 | 2/1993 | Hammett | 206/427 |

*Primary Examiner*—David T. Fidei
*Attorney, Agent, or Firm*—Holland & Knight LLP; Robert L. Wolter, Esq.

[57] ABSTRACT

A crate for storing and transporting cartons having a crate floor and four sidewalls integrally attached to the crate floor extending upward from the floor forming an interior of the crate. The cartons have a plurality of pressure points on the exterior bottom surface of the carton. The crate floor has a plurality of recesses whereby a recess is subjacent each pressure point on the carton despite the position of a carton within the crate. In addition, a recess is subjacent each pressure point wherein each carton within a crate has the same volumetric size and the volumetric size is selected from a plurality of volumetric sizes.

23 Claims, 8 Drawing Sheets

CRATE FOR CARTONS

This invention relates to crates for storing and transporting cartons. More specifically, it relates to those crates for storing and transporting cartons made from paper products and used for holding liquids as dairy or citrus products.

BACKGROUND OF THE INVENTION

Dairy and citrus liquid products are often contained in cartons constructed of cardboard material. This carton is constructed of a single sheet of cardboard material folded to form a bottom, sidewalls and an enclosed top for holding liquid contents. When the paper material is folded and joined together, seams are formed on the interior surface of the bottom of the carton. These seams create pressure points on the exterior surface of the bottom of the crate. Liquid in the cartons has a tendency to seep through these seams and leak from the carton at, and around, the pressure points.

Crates used for storing and transporting cartons usually have a rectangular floor, and four sidewalls, integral the floor, extending upward from the floor forming an interior of the crate in which the cartons are placed. The crates are usually constructed from molded plastic material to form an integral unit. The cartons have a generally rectangular shape so the cartons are aligned side-by-side within the crate. The dimensions of the interior of the carton are such that a set of cartons fits firmly within the crate.

The floor of the crate has a horizontally disposed interior surface. Many of the crate floors have a lattice structure constructed of a plurality of integrally connected ribs. It is generally accepted that the ribbed or lattice structure in crates decreases the overall weight of the crate yet still provides sufficient support for the cartons within the crate. In addition, this type of floor structure provides efficient cleaning for an empty crate and circulation of a carton-filled crate. Unfortunately, the floors of many such crates contact the aforementioned pressure points on the carton bottoms.

When the cartons are placed within the crate, the bottom exterior surface of the carton contacts the interior surface of the crate. More specifically, the pressure points contact the interior surface of the crate floor. This contact between the crate floor, and the bottom of the carton at the pressure points causes the bottom of the carton to flex, which may weaken the seams in the bottom of the carton, and exacerbate seeping and leaking through the seams.

A patent issued to R. L. Erickson, U.S. Pat. No. 3,301,428 is for a "Milk Carton Container". This patent discloses a plurality of grooves and apertures in a bottom wall of the container. These grooves and apertures are apparently designed to provide adequate drainage of water from the container and circulation about cartons positioned in the container. In addition, the sidewalls of the container space leak-producing areas of the cartons from the corners of the container.

SUMMARY OF THE INVENTION

In view of the aforementioned shortcomings and problems with crates, an object of this invention is to provide a crate with a floor that adequately supports cartons placed within the crate yet does not aggravate leaking, or cause the carton to leak through the carton bottom.

Another object of this invention is to provide the crate with a floor that avoids the pressure points on the bottom of each carton.

Still another object is to provide such a crate whereby the cartons within a crate are selected from a plurality of volumetric sizes of cartons, but each carton in the crate has the same volumetric size, and the floor is adapted to avoid the pressure points on any volumetric size selected from the plurality of volumetric sizes. In addition, the pressure points on the bottom of the carton do not contact the crate despite the orientation of the carton within the crate.

Yet another objective is to provide such a crate that is lightweight and easy to handle but sufficiently rigid to support cartons for storage and transportation as well as stacking with a plurality of crates. The crate is also easy to rinse and clean.

These and other objectives are achieved by providing a crate having a floor and sidewalls, integral the floor, which extend upward from the floor forming an interior of the crate. The floor has an interior surface that supports a plurality of cartons. Each carton has a bottom and four sidewalls extending upward from the carton bottom forming an interior of the carton. The bottom interior surface of the container has seams that form pressure points on the exterior bottom surface of the carton.

The interior surface of the floor has a plurality of carton supporting surfaces on which the cartons are placed. A plurality of recesses are formed in each carton supporting surface forming a recessed pattern in the crate floor whereby a recess is subjacent a pressure point on each carton when a carton is placed on the supporting area in any one of a number of positions. In addition, the recessed pattern accommodates the cartons so a recess is subjacent a pressure point on the carton bottom whereby a plurality of cartons may vary in volumetric size, but each carton in the crate is the same volumetric size. Each carton in the crate has the same volumetric size that has been selected from a plurality of volumetric sizes. For example, each carton of the plurality of cartons are the same size of either a half pint, one pint or one half gallon volume carton.

DETAILED DESCRIPTION OF THE DRAWINGS

Figure 1:
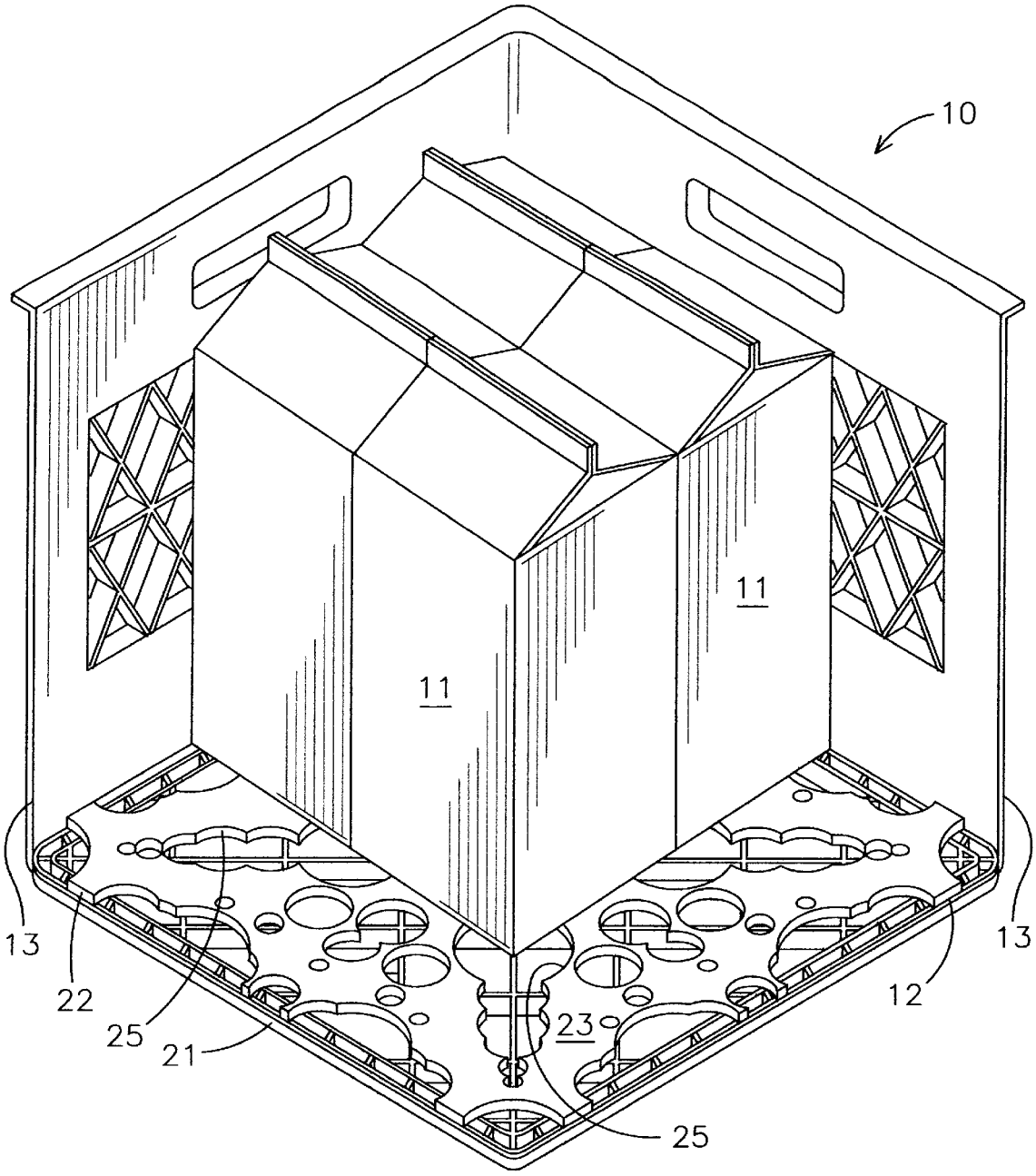
FIG. 1 is a perspective view of the interior of the crate with cartons on the crate floor.
Figure 2:
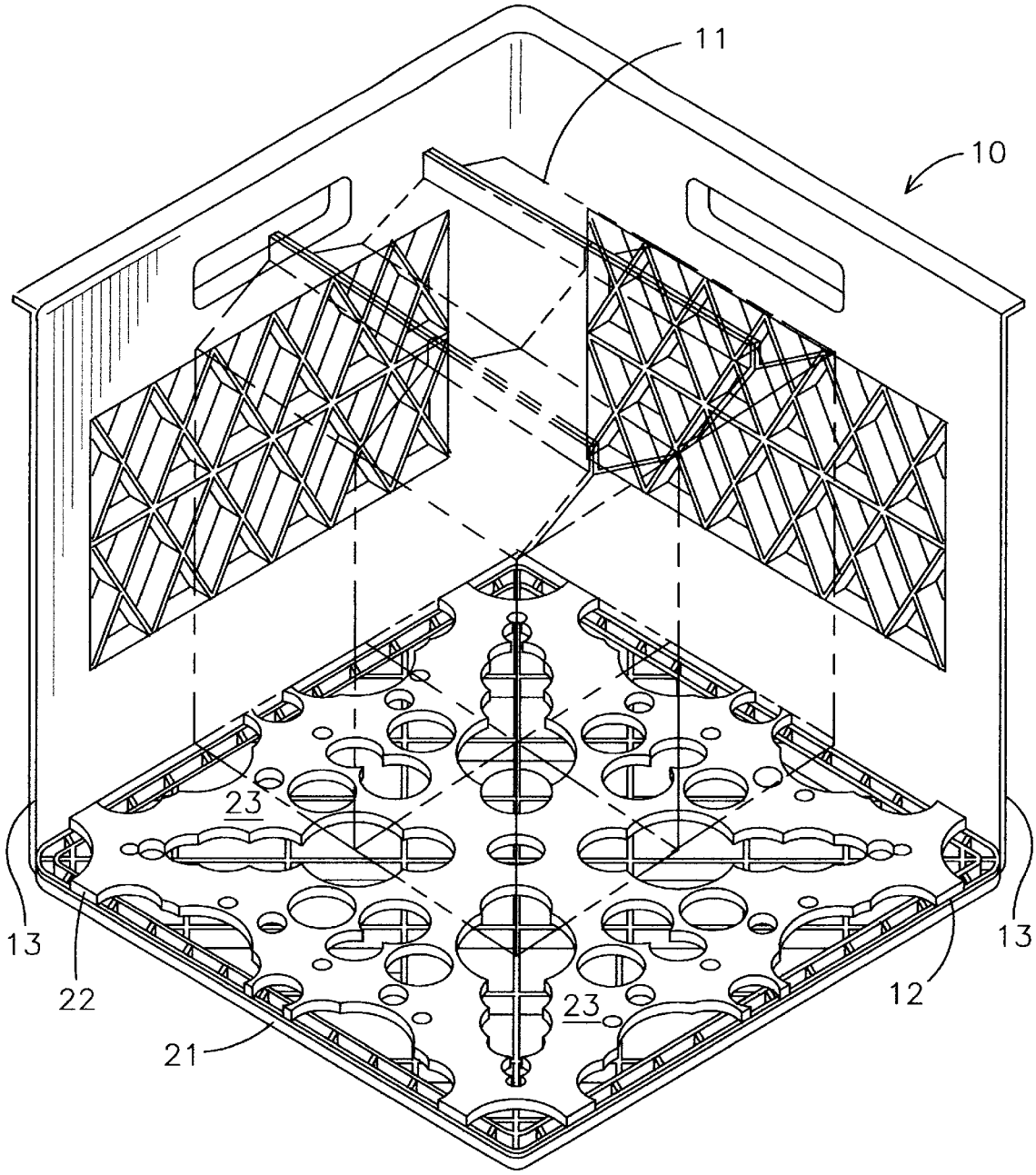
FIG. 2 is a perspective view of the interior of the carton showing the crate floor.

The invention is for the crate 10 having the crate floor 12 illustrated in FIGS. 1–4 and 8. The crate 10 supports cartons 11 which are arranged side-by-side within the crate 10, as shown in FIGS. 1 and 2. As with most dairy crates, this crate 10 includes a crate floor 12 and sidewalls 13. The entire unit is constructed of plastic, molded to form an integral unit. The particular embodiment illustrated in this invention contains dairy cartons 14 having a rectangular shape. Accordingly, the crate floor 12 is rectangular with four sidewalls 13.

Figure 15:
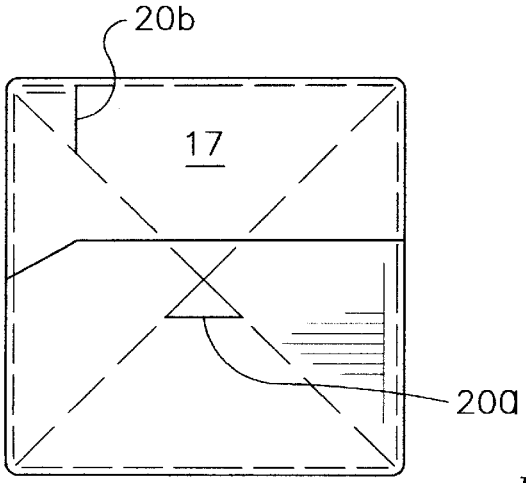
FIG. 15 is a planar view of the exterior of the bottom of a carton.
Figure 16:
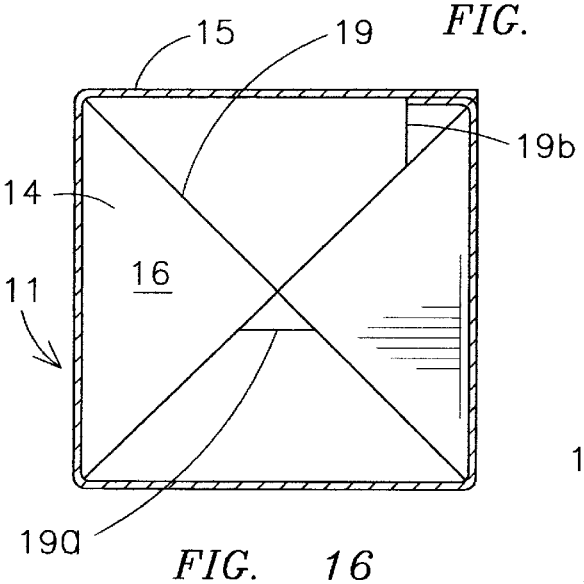
FIG. 16 is a planar view of the interior of a carton.
Figure 17:
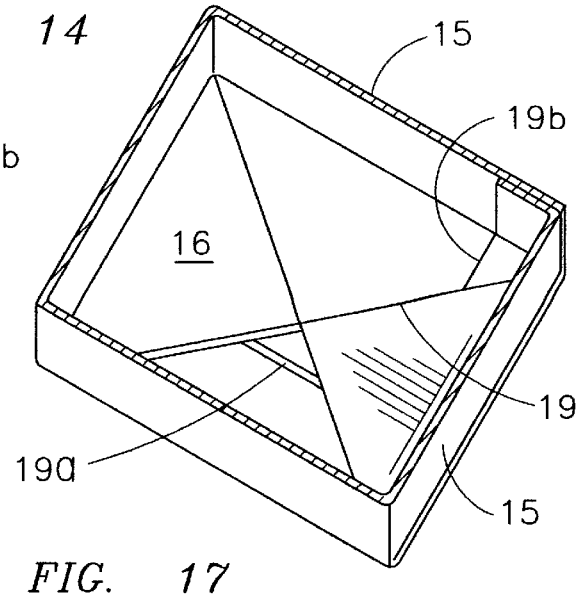
FIG. 17 is a perspective view of the interior of a carton.

Dairy cartons, or similar beverage cartons, are constructed of cardboard material which is folded and sealed to form an enclosed interior. The carton 11, as shown in FIGS. 16 and 17, has a bottom 14 with four side walls 15. The bottom 14 has an interior surface 16 and exterior surface 17 (FIG. 15). Seams 19 are on the interior surface 16 of the carton bottom 14. The seams 19 of particular interest, with respect to this invention, are a central seam 19*a* and corner seam 19*b*.

These seams 19*a* and 19*b* form pressure points 20*a* and 20*b* on the exterior surface 17 of the carton bottom 14 coextensive with the seams 19*a* and 19*b*. When the carton bottom 14 contacts a crate floor 12, the bottom 14 has a tendency to flex slightly weakening the seams 19*a* and 19*b*. Liquid leaks from the carton 11 through the central seam 19*a* and corner seam 19*b* along the pressure points 20*a* and 20*b*. The floor 12 of the crate 10 has been adapted to create voids in the crate floor 12 subjacent the central seam 19*a* and the corner seam 19*b* on the carton bottom 14.

Figure 3:
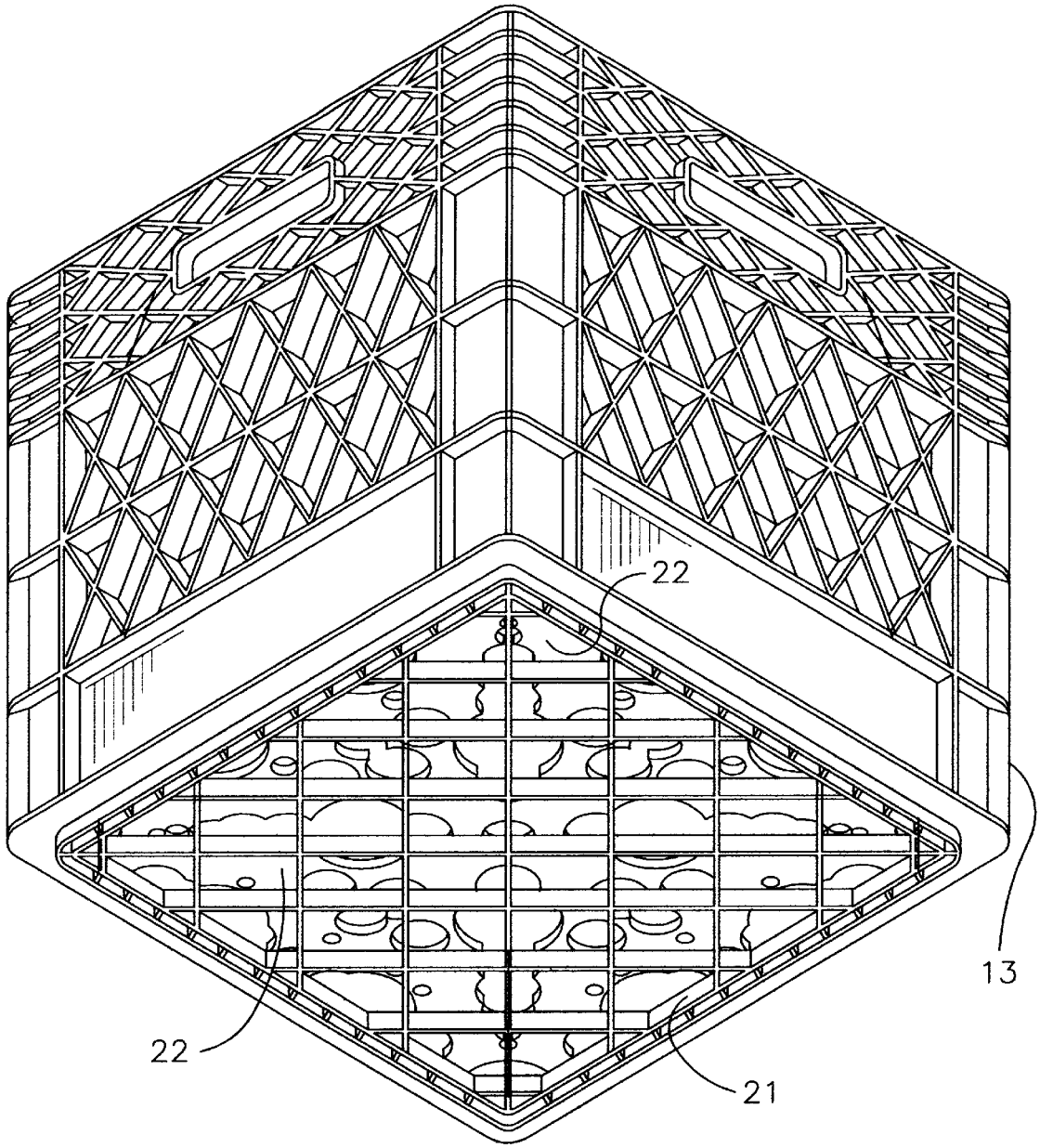
FIG. 3 is a perspective view of the exterior of the crate floor.
Figure 4:
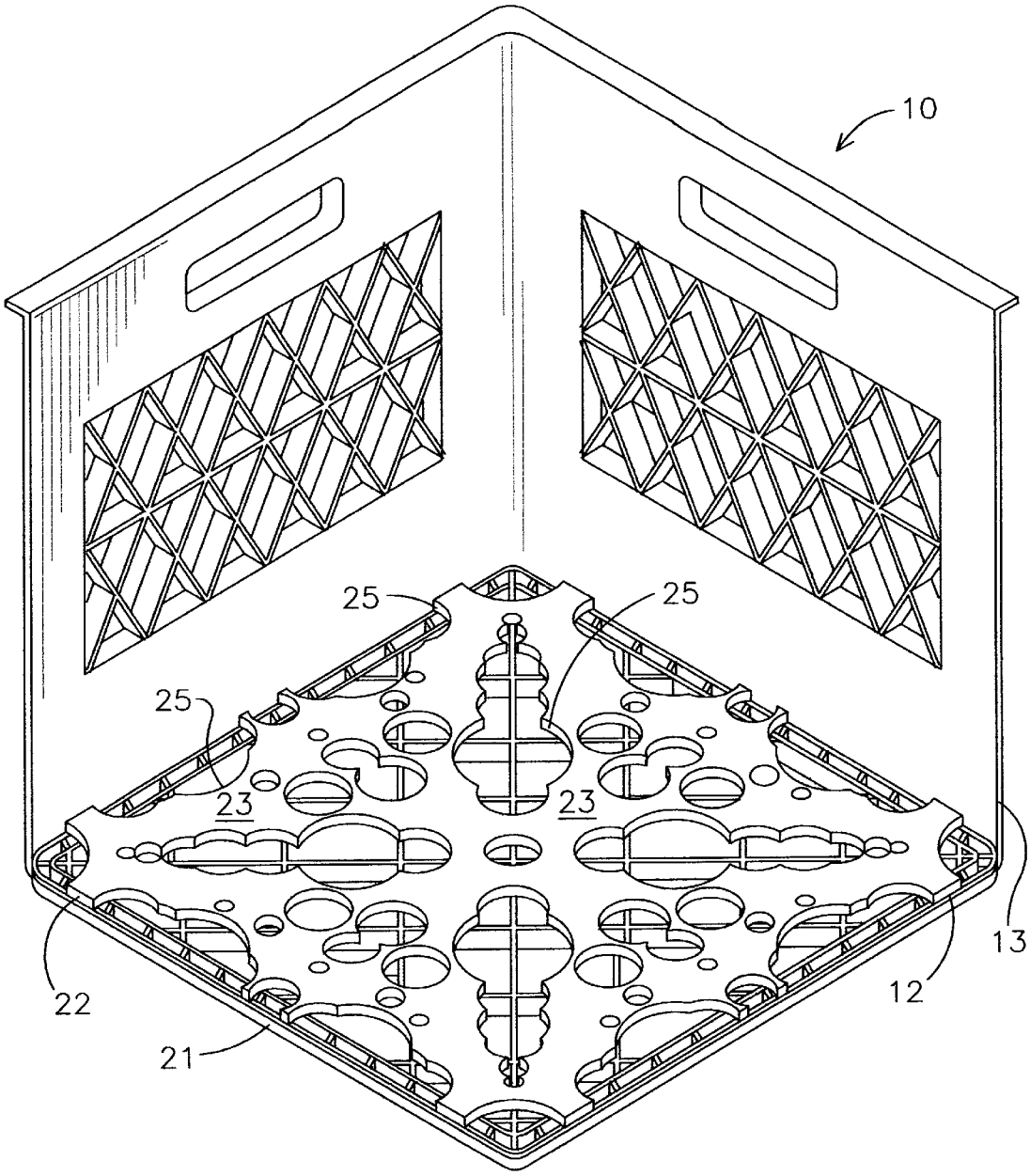
FIG. 4 is a perspective view of the interior of the crate and the crate floor.

The crate floor 12, shown in FIGS. 3 and 4, has a lower support layer 21 and an upper support layer 22. The lower support layer 21 is a lattice structure integrally connected to the four sidewalls 13 and upper support layer 22. The upper support layer 22 has an interior surface 23 upon which cartons 11 are placed.

Figure 5:
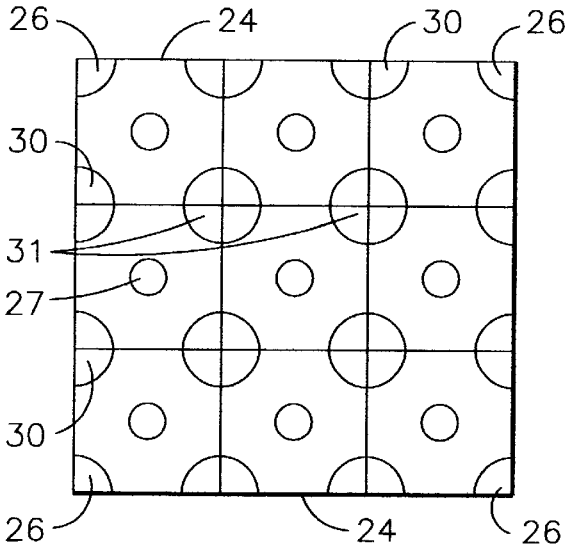
FIG. 5 is a top planar view of the crate floor with recesses showing carton support surfaces for a first carton size.
Figure 6:
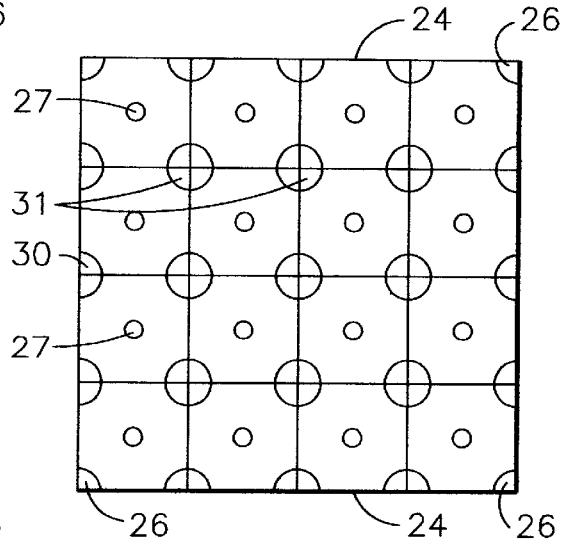
FIG. 6 is a top planar view of the crate floor with recesses showing carton support surfaces for a second carton size.
Figure 7:
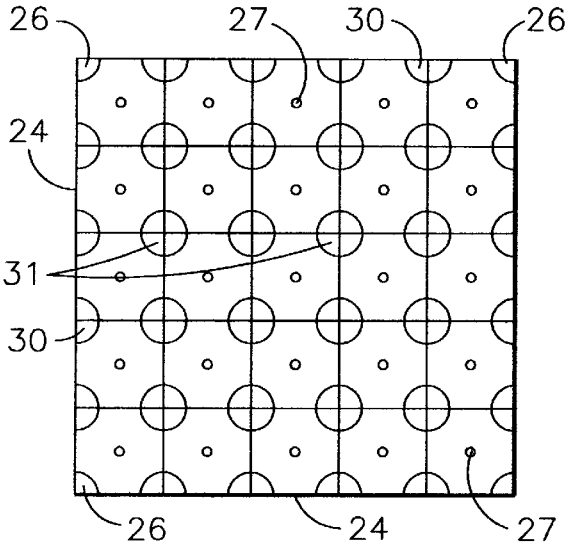
FIG. 7 is a top planar view of the crate floor with recesses showing carton support surfaces for a third carton size.

As depicted in FIGS. 5–7, the interior surface 23 of the floor 12 has a plurality of support surfaces 24 and each support surface 24 corresponds to a carton bottom 14. The horizontal and vertical lines have been added to the drawing to represent a shape and size of the support surfaces 24. Cartons are made in a variety of sizes and shapes. The crate floor 12 is adapted to accommodate varying sizes of cartons. It is not intended to limit this invention by the shape or size of the cartons represented in this specification. These are provided to illustrate an embodiment and best mode of the invention.

As noted above, each support surface 24 corresponds to the carton bottom 14. The interior surface 23 of the crate floor 12, shown in FIG. 5, represents an interior surface of a floor 12 for a plurality of one-half gallon cartons. The interior surface 23 depicted in FIG. 6 represents a interior surface 23 of a floor 12 for a plurality of one-pint cartons. The interior surface 23, shown in FIG. 7, represents a interior surface 23 of a floor 12 for a plurality of one-half pint cartons. Cartons 11 are placed within the crate 10 resting on the floor 12 and contact the interior surface 23 of the crate floor 12. The bottom 14 of each carton 11 outlines and defines each support surface 24.

Figure 9:
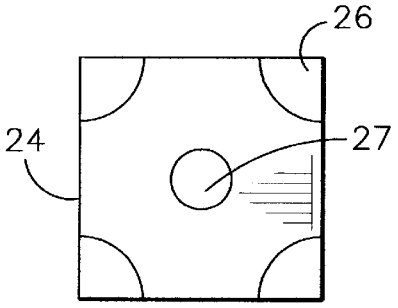
FIG. 9 is a single support surface of a crate floor for a first carton size.
Figure 10:
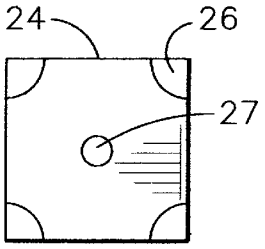
FIG. 10 is a single support surface of a crate floor for a second carton size.
Figure 11:
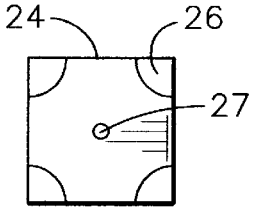
FIG. 11 is a single support surface of a crate floor for a third carton size.

A plurality of recesses 25 are formed in the interior surface 23 of the floor 12 to create a void subjacent each pressure points 20*a* and 20*b* on the bottom 14 of the carton 11. The recesses 25 form a pattern, as shown in FIGS. 1–4 & 8, that accommodates a variety of sizes of cartons 11 placed within a crate 10, such that pressure points 20*a* and 20*b* are always positioned over a recess 25. Five recesses 25 are located within each support surface 24. As shown in FIGS. 9–11, a corner recess 26 is formed in each of the four corners of a support surface 24 for the pressure point 20*b* along the corner seam 19*b* of the carton bottom 14. In addition, a circular central recess 27 is centrally located in each support surface 24 for a pressure point 20*a* along a central seam 19*a* of a carton bottom 14.

A carton placed within a crate may be placed in a number of positions, the seams 19*a* and 19*b* and pressure points 20*a* and 20*b* are consequently oriented in a plurality of positions on each support surface 24. Each support surface 24 has a central vertical axis. When a carton is to be placed within the crate, it is coaxially aligned with the central vertical axis of a corresponding support surface 24. The carton 11 may be rotated about its central axis so that the corner seam 19*b* may be placed in any one of the four corners of a support surface 24. Similarly, the central seam 19*a* may be located in any one of four positions about a central vertical axis of the support surface 24.

Figure 8:
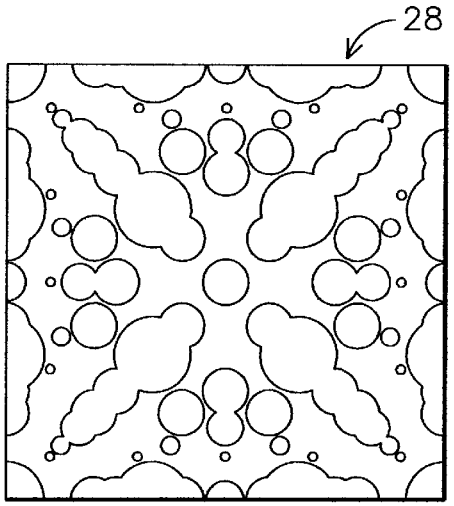
FIG. 8 is a top planar view of the crate floor with recesses for different size cartons.

The crate floor 12, shown in FIG. 8, includes an interior surface 23 incorporating each of the recesses in FIGS. 5, 6 and 7. As shown in FIGS. 1 and 2, the interior surface 23 of the crate floor 12 is horizontally disposed within the crate sidewalls 13 to support cartons 11. The recesses 25 create a pattern 28 that provides a recess 25 subjacent pressure points 20*a* and 20*b* on the exterior surface carton bottom 14, on the respective seams 19*a* and 19*b* of the interior surface 16 of the crate bottom 14, regardless of the orientation of the carton 11 on each support surface 24. For example, each of the FIGS. 12–14 illustrates the four different positions of cartons 11 placed on a support surface 24 within the crate 10.

In addition, the recessed pattern 28, shown in FIGS. 1–4 and 8, works for a variety of sizes of a plurality of cartons 11. This recessed pattern 28 includes recesses 25 subjacent each pressure point 20*a* and 20*b* on seams 19*a* and 19*b*, whereby the volumetric size of different sets, or pluralities, of cartons 11 may vary, but each carton 11 of a plurality of cartons within the crate 10 is the same volumetric size. The volumetric size of the cartons 11 the crate may be selected form a variety of carton sizes; each carton of a selected volumetric size within a crate has the same volumetric size; however, a recess is subjacent each pressure point 20*a* or 20*b* for any one of the plurality of different volumetric sizes.

Figure 12:
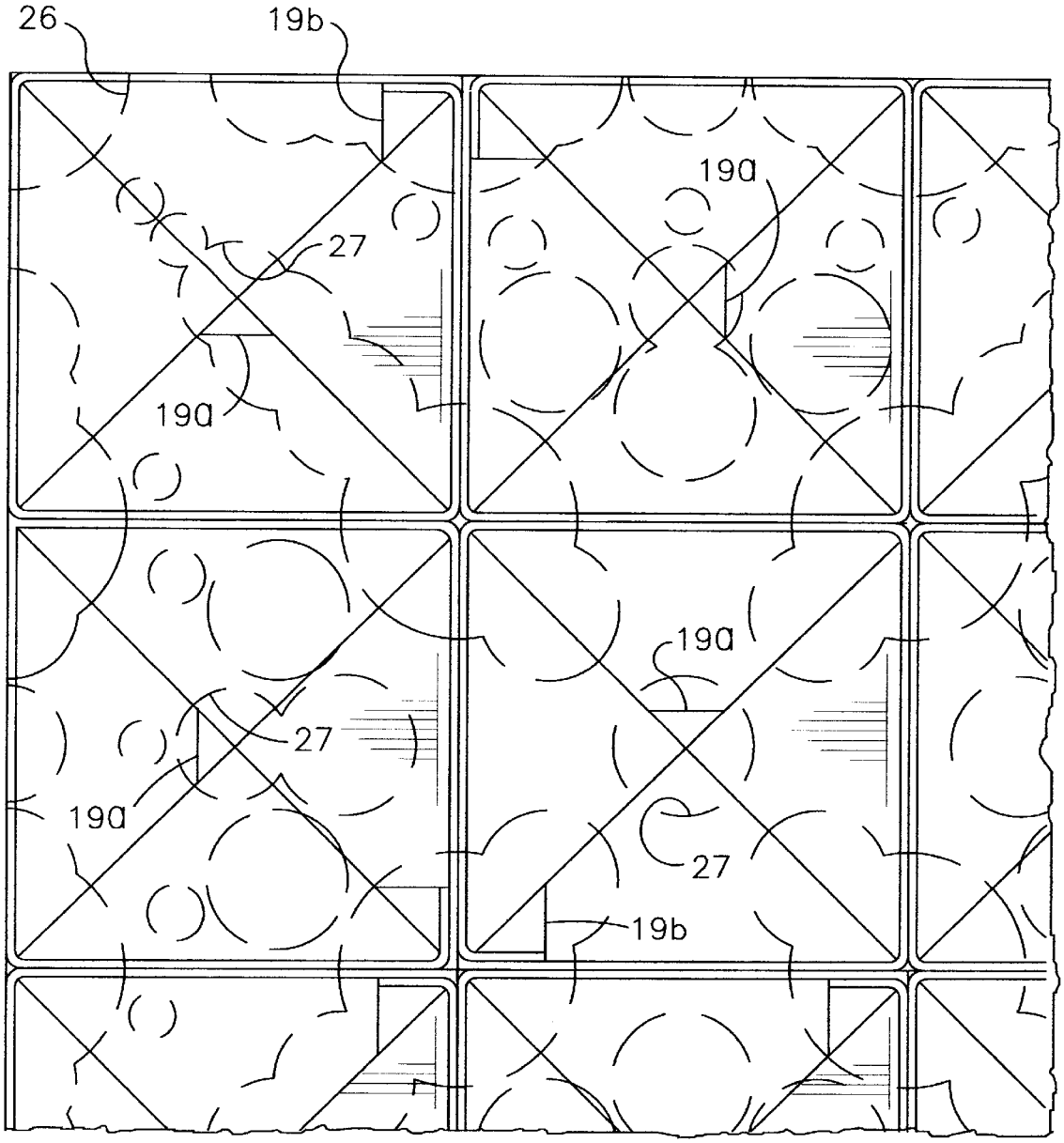
FIG. 12 is a top partial planar view of the crate floor with a plurality of cartons of a first volumetric size.
Figure 13:
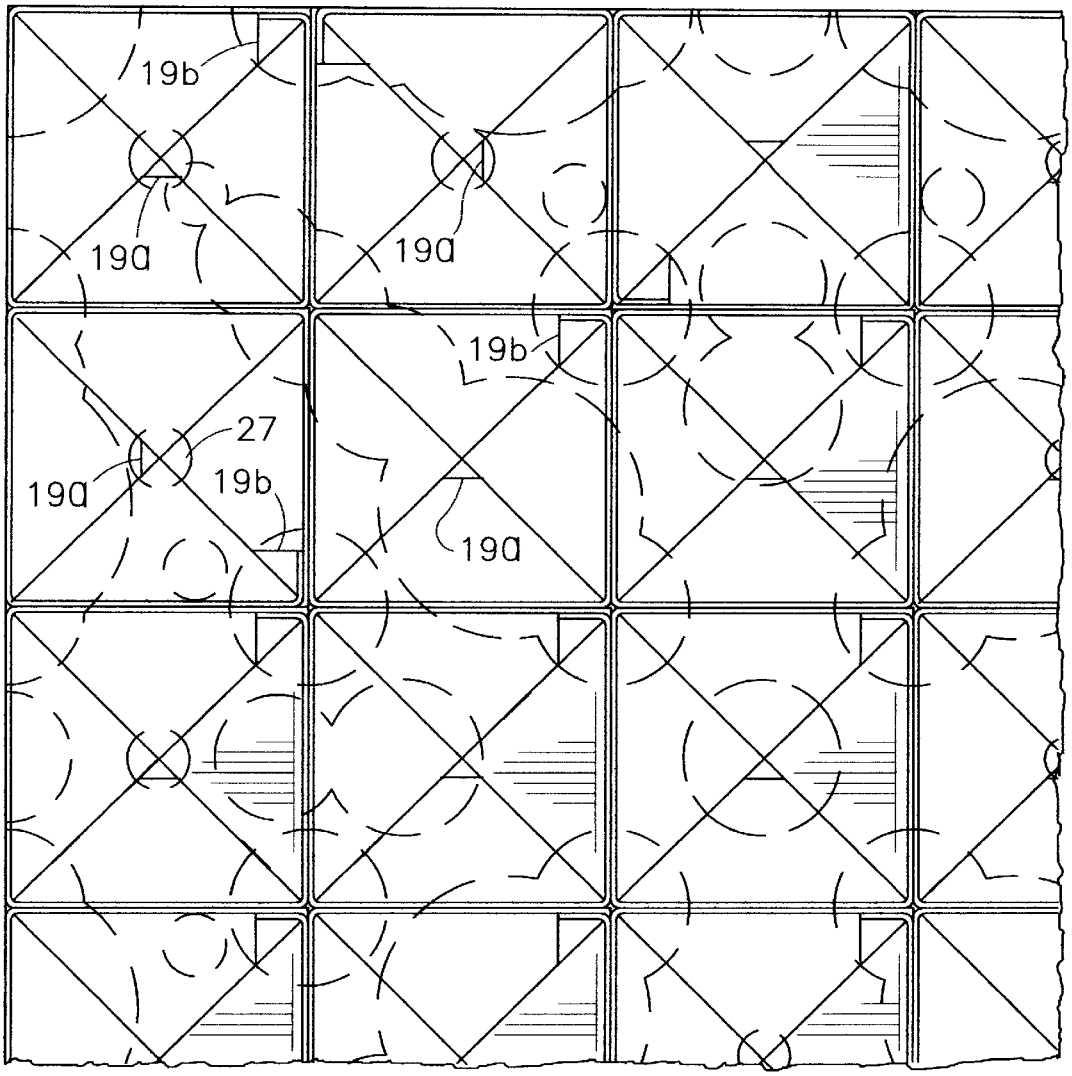
FIG. 13 is a top partial planar view of the crate floor with a plurality of cartons of a second volumetric size.
Figure 14:
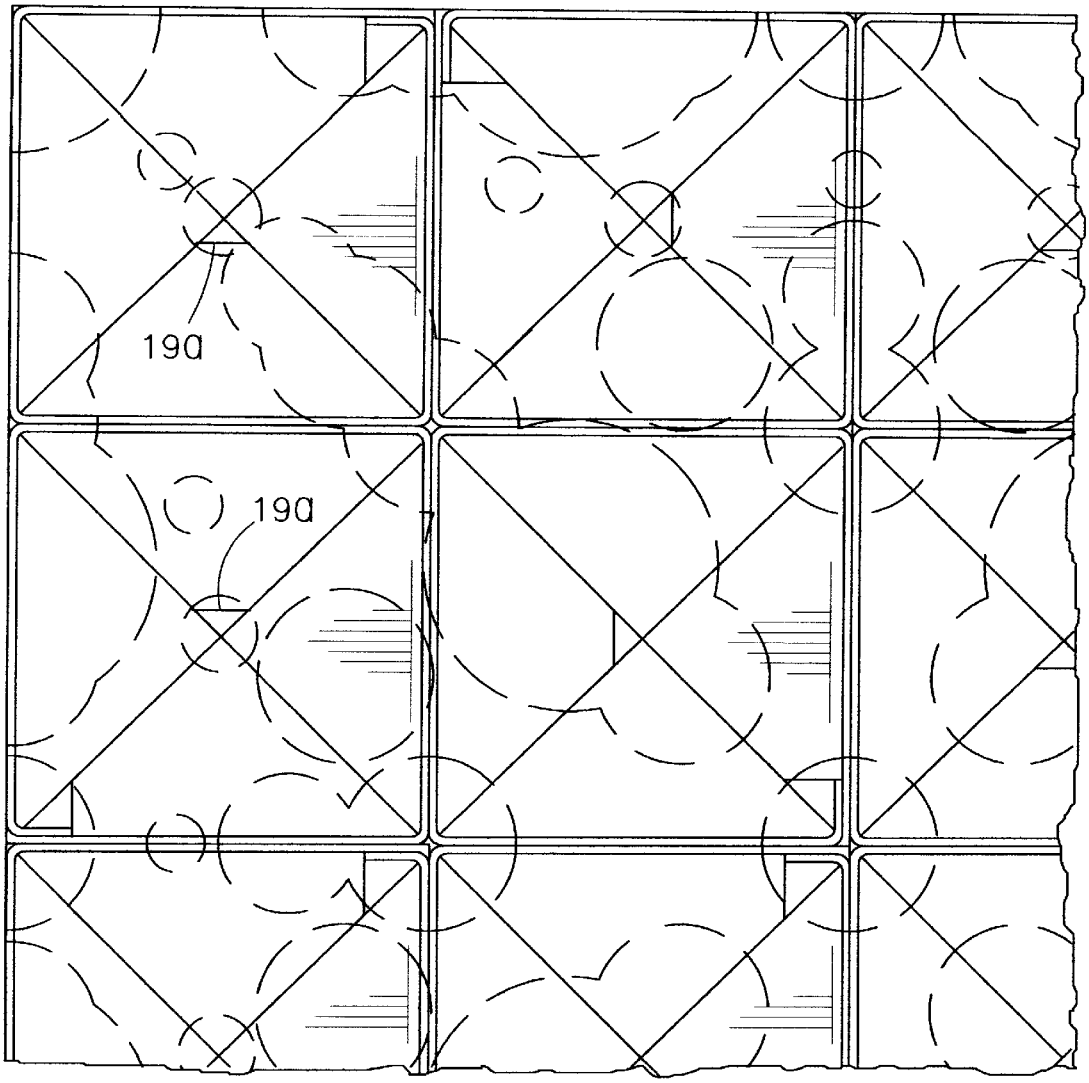
FIG. 14 is a top partial planar view of the crate floor with a plurality of cartons of a third volumetric size.

With respect to FIGS. 12–14, there is shown a partial top planar view of a crate floor 12 having a plurality of cartons 11 placed thereon. In FIG. 12, for example, four one-half gallon cartons are shown in four different positions. In FIG. 13, nine one-pint cartons are shown in various positions; and in FIG. 14, four one-half pint cartons are illustrated in different positions. In each instance, a recess 25 is subjacent a pressure points 20*a* and 20*b* on the respective seams 19*a* and 19*b*, despite the different volumetric sizes of the carton or the orientation of the carton 11 within the crate 10.

The recesses 25 create a void beneath the pressure points 20*a* and 20*b* on the carton bottom 14. Thus, contact is avoided at these pressure points 20*a* and 20*b* that may otherwise aggravate any potential leaking from a carton. Moreover, the recesses 25 are such a size that the interior surface 23 of the crate floor 12 remains a contiguous surface, or layer, sufficient to support the cartons 11 within the crate 10.

In the embodiment, disclosed herein, a crate floor 12, disposed within the sidewalls 13, is approximately a twelve inch square. In FIGS. 5 and 12, each support surface 24 for a half-gallon carton is a four inch square; in FIG. 6, each support surface 24 for a one-pint carton is a 3-inch square; and in FIG. 7, each support surface 24 for a half-pint carton is a 2.25 inch square.

With respect to FIGS. 5–8, a corner recess 26 is formed in the interior surface 23 of the crate 10 in each corner of the crate 10. A plurality of side recesses 30 are formed in the interior surface 23 along each sidewall 13 intermediate the corner recesses 26. The junction of two support surfaces 24 against sidewall 13 divides these recesses into two corner recesses 26 for respective support surfaces 24. In FIG. 5, each of the corner recesses 26 and side recesses 30 for one-half gallon cartons have a radius of 1.125 inches; in FIG. 6, each of the corner recesses 26 and side recesses 30 for the one-pint cartons has a radius of 0.625 inches; and, in FIG. 7 each of the corner recesses 26 and side recesses 30 for the one-half pint cartons has a radius of 0.5 inches.

A plurality of circular interior recesses 31 are aligned with, and formed, intermediate the opposing side recesses 30 that are along sidewalls 13. The junction from support surfaces 24 divides each of these circular interior recesses 31 into four corner recesses 26, whereby each is a corner recess 26 for a respective support surface 24. With respect to FIG. 5, each interior circular recess 31 for a half-gallon carton support surface 24, has a diameter of 2.25 inches (forming four corner recesses, each having a radius of 1.125); in FIG. 6, each interior circular recess 31, for the one-pint carton support surfaces 24, has a diameter of 1.25 inches (forming four corner recesses each having a radius of 0.625 inches); and in FIG. 7, each interior circular recess 31, on a half-pint carton support surface 24, has a diameter of 1 inch (forming four corner recess each having a radius of 0.5 inches). One skilled in the art may appreciate that these interior circular recesses 31 are centered on the junction of four support surfaces 24 and spaced equidistant apart in a line between opposing side recesses 30.

The pressure point 20*a* along the central seam 19*a* of the carton bottom 14 is positioned over a central recess 27 formed in the center of each support surface 24. These central recesses 27 are large enough to create a void subjacent the pressure point 20*a* (and 20*b*) along the central seam 19*a*, in any orientation of the central seam 19*a* about an central vertical axis of the carton 11. The central recesses 27 in each of the FIGS. 5–7, are arranged in rows or columns, and are spaced equidistant apart from each other within the row or column to align the recess 27 at the center of each support surface 24. With respect to FIG. 5., the central recess 27 for each support surface 24 of a half-gallon carton has a 1 inch diameter; in FIG. 6, the central recess 27 for each one pint carton support surface 24 has a 0.5 inch diameter and, in FIG. 7 the support surface 24 of a half-pint carton is 0.25 inches.

The crate floor 12, as shown in FIGS. 5–7, are overlain to form the recessed pattern 28 shown in FIG. 8. This recessed pattern 28 provides sufficient surface area of the interior surface 23 of the floor to support the cartons. In addition, the recesses 25 are positioned to place a recess 25 subjacent each of the pressure points 20*a* and 20*b* for different size cartons 11. This relieves pressure at the contact points 20*a* and 20*b* on the carton bottom 14.

While I have disclosed the preferred embodiment of my invention, it is not intended that this description in any way limits the invention, but rather this invention should be limited only by a reasonable interpretation of the new recited claims.

Having thus described my invention, what I claim as new and desire to secure by Letter Patent is:

1. A crate for holding a plurality of cartons, said crate comprising:

a) a crate floor and a plurality of sidewalls attached to the crate floor extending upward therefrom, forming an interior of the crate;

b) a plurality of cartons in said crate, each said carton having a bottom;

c) at least one pressure point on the bottom of each carton;

d) a plurality of recesses formed in the crate floor wherein a recess is subjacent a pressure point on the bottom of each carton; and e) wherein said crate floor includes an upper support layer and a lower support layer.

2. A crate, as defined in claim 1, wherein said upper support layer includes a horizontally disposed contiguous an interior surface of the crate floor, and said plurality of recesses are formed in the interior surface of the crate floor.

3. A crate, as defined in claim 2, wherein said interior surface includes a plurality of carton support surfaces integral the interior surface of the carton, each said carton support surface corresponding to a bottom of a carton and having a recess formed therein subjacent each pressure point on a carton bottom on said carton support surface.

4. A crate, as defined in claim 3, wherein said carton has a plurality of sidewalls integrally attached to the carton bottom, extending upward therefrom forming an interior of the carton, and said carton bottom having an interior surface and an exterior surface, with a corner seam and central seam on the interior surface of the carton bottom and a first pressure point on the exterior surface of the carton bottom adjacent the corner seam and a second pressure point on the exterior bottom surface of the carton bottom adjacent the central seam, and each pressure point is capable of being positioned in a plurality of positions on a carton support surface, and said carton support surface has a plurality of recesses, whereby a recess is subjacent a pressure point in any one of said plurality of positions of said pressure points on a carton support surface.

5. A crate, as defined in claim 4, wherein said carton bottom has a rectangular shape and said carton support surface has a rectangular shape corresponding to said carton bottom, and said plurality of recesses in said carton support surfaces include a corner recess in each corner of the carton support surface and a recess in a center of the carton support surface.

6. A crate, as defined in claim 5, wherein each said carton within said plurality of cartons has the same volumetric size and said volumetric size is selected from a plurality of volumetric sizes, whereby a recess is subjacent each pressure point on each carton from any said volumetric size selected from said plurality of volumetric sizes.

7. A crate for holding a plurality of cartons, said crate comprising:

a) a crate floor and a plurality of sidewalls attached to the crate floor extending upward therefrom, forming an interior of the crate;

b) a plurality of cartons in said crate, each said carton having a bottom;

c) at least one pressure point on the bottom of each carton;

d) a plurality of recesses formed in the crate floor wherein a recess is subjacent a pressure point on the bottom of each carton;

e) wherein said interior surface includes a plurality of carton support surfaces, each said support surface corresponding to a bottom of a carton and having at least one recess formed therein subjacent each pressure point on the bottom of the carton;

f) wherein said carton has a plurality of sidewalls integrally attached to the carton bottom, extending upward therefrom forming an interior of the carton, and said carton bottom having an interior surface and an exterior surface, with a corner seam and a central seam on the interior surface of the carton bottom and a first pressure point on the exterior surface of the carton bottom adjacent the corner seam and a second pressure point on the exterior bottom surface of the carton bottom adjacent the central seam, and each pressure point is capable of being positioned in a plurality of positions on the carton support surface and said carton support surface has a plurality of recesses, whereby a recess is subjacent a pressure point in any one of said plurality of positions of said pressure points on a carton support surface; and g) wherein said carton bottom has a rectangular shape and said carton support surface has a rectangular shape corresponding to said carton bottom, and said plurality of recesses in said carton support surfaces includes a corner recess in each corner of the support surface and a recess in a center of the carton support surface.

8. A crate for storing and transporting cartons, said crate comprising:

a) a crate floor integral a plurality of sidewalls which extend upward from the floor forming an interior of the crate, said crate floor having an interior surface;

b) a plurality of cartons capable of being placed within said crate, each said carton having a bottom integrally attached to upwardly extending sidewalls forming an interior of the carton, said carton bottom having an interior surface and an exterior surface;

c) at least one pressure point on the exterior surface of each carton bottom;

d) a plurality of carton support surfaces integral the interior surface of the crate floor;

e) at least one recess formed in each carton support surface whereby a recess is subjacent each pressure point on a carton bottom;

f) wherein said carton has a plurality of sidewalls integrally attached to the carton bottom, extending upward therefrom forming an interior of the carton, and said carton bottom includes an interior surface and an exterior surface, with a corner seam and a central seam on the interior surface of the carton bottom and a first pressure point on the exterior surface of the carton bottom adjacent the corner seam, and a second pressure point on the exterior bottom surface of the carton bottom adjacent the central seam, and each pressure point is capable of being positioned in a plurality of positions on the carton support surface and said carton support surface has a plurality of recesses, whereby a recess is subjacent a pressure point in any one of said plurality of positions of said pressure points on a carton support surface; and g) wherein said carton bottom has a rectangular shape and said carton support surface has a rectangular shape corresponding to said carton bottom, and said plurality of recesses in said carton support surfaces includes a corner recess in each corner of the support surface and a recess in a center of the carton support surface.

9. A crate, as defined in claim 8, wherein each said carton within said plurality of cartons has the same volumetric size and said volumetric size is selected from a plurality of volumetric sizes whereby a recess is subjacent each pressure point on each carton bottom having any volumetric sizes selected from said plurality of volumetric sizes.

10. A crate for storing and transporting cartons, said crate comprising:

a) a crate floor integral a plurality of sidewalls which extend upward from the floor forming an interior of the crate, said crate floor having an interior surface;

b) a plurality of cartons capable of being placed within said crate, each said carton having a bottom integral upwardly extending sidewalls forming an interior of the carton and said carton having a bottom which has an interior surface and an exterior surface;

c) at least one seam on the interior surface of the carton bottom and a pressure point on the exterior surface of the carton bottom adjacent each seam; and, d) a plurality of recesses formed in the interior surface of the carton floor whereby a recess is subjacent each pressure point on each carton bottom.

11. A crate, as defined in claim 10, wherein each carton is placed within the crate and each pressure point is capable of being positioned in the crate in any one of a plurality of positions with respect to the interior surface of the carton and a recess is subjacent each pressure point on each carton in any one of said plurality of positions.

12. A crate, as defined in claim 10, wherein each said carton within said plurality of cartons in a crate has the same carton volumetric size and said carton volumetric size is selected from a plurality of volumetric sizes of cartons whereby a recess is subjacent to each pressure point on any carton volumetric sizes selected from said plurality of volumetric sizes.

13. A crate, as defined in claim 10, wherein said interior surface includes a plurality of carton support surfaces integral the interior surface, each said support surface corresponding to a bottom of a carton and having at least one recess formed therein subjacent each pressure point on the bottom of the carton.

14. A crate, as defined in claim 13, wherein said carton includes a corner seam and central seam on the interior surface of the carton bottom and a first pressure point on the exterior surface of the carton bottom is adjacent the corner seam and a second pressure point on the exterior bottom surface of the carton bottom adjacent the central seam, and each pressure point is capable of being positioned in a plurality of positions on a carton support surface, and said carton support surface has a plurality of recesses, whereby a recess is subjacent a pressure point in any one said plurality of positions of said pressure points on a carton support surface.

15. A crate, as defined in claim 14, wherein said carton bottom has a rectangular shape and said carton support surface has a rectangular shape corresponding to said carton bottom, and said plurality of recesses in said carton support surfaces includes a corner recess in each corner of the support surface and a recess in a center of the carton support surface.

16. A crate for storing and transporting cartons, said crate comprising:

a) a crate floor integral a plurality of sidewalls which extend upward from the crate floor forming an interior of the crate and said crate floor having an interior surface;

b) a plurality of cartons, each said carton having a bottom and sidewalls integral and extending upward from the carton bottom, said carton bottom having an interior surface and an exterior surface and at least one pressure point on the exterior surface of the carton bottom, and each said carton having the same volumetric size selected from a plurality of volumetric sizes of cartons;

c) a plurality of recesses formed in the interior surface of the crate floor whereby a recess is subjacent a pressure point on each carton bottom for a carton having any one of said volumetric sizes selected from said plurality of volumetric sizes of the cartons; and d) wherein each said carton is placed in the crate whereby each pressure point is capable of being positioned in the crate in any one of a plurality of positions with respect to the interior surface of the crate floor and a recess is subjacent each pressure point in any one of said plurality of said positions of said pressure points.

17. A crate, as defined in claim 16, wherein said interior surface includes a plurality of carton support surfaces integral the interior surface, each said support surface corresponding to a bottom of a carton and having at least one recess formed therein subjacent each pressure point on the bottom of the carton.

18. A crate, as defined in claim 17, wherein said carton includes a corner seam and central seam on the interior surface of the carton bottom and a first pressure point on the exterior surface of the carton bottom is adjacent the corner seam and a second pressure point on the exterior bottom surface of the carton bottom is adjacent the central seam, and each pressure point is capable of being positioned in a plurality of positions on a carton support surface, and said carton support surface has a plurality of recesses, whereby a recess is subjacent a pressure point in any one said plurality of positions of said pressure points on a carton support surface.

19. A crate for storing and transporting cartons, said crate comprising:

a) a crate floor integral a plurality of sidewalls which extend upward from the crate floor forming an interior of the crate and said crate floor having an interior surface;

b) a plurality of cartons, each said carton having a bottom integral a plurality of sidewalls extending upward from the carton bottom forming an interior of the carton, said carton bottom having an interior surface and an exterior surface, and at least one pressure point on the exterior surface of the carton bottom, each said carton placed within the crate whereby each pressure point is capable of being positioned in the crate in any of a plurality of positions on the crate floor; and, c) a plurality of recesses formed in the interior surface of the crate floor whereby a recess is subjacent each pressure point on each carton in any one of said plurality of positions of said pressure points in the crate.

20. A crate, as defined in claim 19, wherein each said carton has the same volumetric size selected from a plurality of volumetric sizes of a plurality of cartons and a recess subjacent a pressure point on each carton bottom for a carton having any said volumetric size selected from said plurality of volumetric sizes of cartons.

21. A crate, as defined in claim 19, wherein said crate further includes a plurality of support surfaces integral the interior surface of the crate, each said support surface corresponding to a carton bottom and having a plurality of recesses.

22. A crate, as defined in claim 21, wherein said carton includes a corner seam and central seam on the interior surface of the carton bottom and a first pressure point on the exterior surface of the carton bottom adjacent the corner seam and a second pressure point on the exterior bottom surface of the carton bottom adjacent the central seam, and each pressure point is capable of being positioned in a plurality of positions on a carton support surface, and said carton support surface has a plurality of recesses, whereby a recess is subjacent a pressure point in any one said plurality of positions of said pressure points on a carton support surface.

23. A crate, as defined in claim 22, wherein said carton bottom has a rectangular shape and said carton support surface has a rectangular shape corresponding to said carton bottom, and said plurality of recesses in said carton support surfaces includes a corner recess in each corner of the support surface and a recess in a center of the carton support surface.

* * * * *